US010745992B2

(12) United States Patent
Cheng et al.

(10) Patent No.: US 10,745,992 B2
(45) Date of Patent: Aug. 18, 2020

(54) PRESSURE ENERGIZED SEAL ACTUATOR RING

(71) Applicant: GE Oil & Gas Pressure Control LP, Houston, TX (US)

(72) Inventors: Samuel Heung Yeung Cheng, Houston, TX (US); Wei He, Houston, TX (US); Kevin O'Dell, Houston, TX (US); Joseph Pallini, Tomball, TX (US)

(73) Assignee: GE OIL & GAS PRESSURE CONTROL LP, Houston, TX (US)

( * ) Notice: Subject to any disclaimer, the term of this patent is extended or adjusted under 35 U.S.C. 154(b) by 0 days.

(21) Appl. No.: 16/377,633

(22) Filed: Apr. 8, 2019

(65) Prior Publication Data

US 2019/0309598 A1 Oct. 10, 2019

Related U.S. Application Data

(60) Provisional application No. 62/654,010, filed on Apr. 6, 2018.

(51) Int. Cl.

| | |
|---|---|
| ***E21B 33/04*** | (2006.01) |
| ***E21B 33/128*** | (2006.01) |
| ***E21B 47/10*** | (2012.01) |
| *E21B 33/00* | (2006.01) |

(52) U.S. Cl.

CPC ..... *E21B 33/128* (2013.01); *E21B 33/04* (2013.01); *E21B 47/1025* (2013.01); *E21B 2033/005* (2013.01)

(58) Field of Classification Search

CPC ..... E21B 33/04; E21B 33/128

See application file for complete search history.

(56) References Cited

U.S. PATENT DOCUMENTS

| | | | | |
|---|---|---|---|---|
| 4,665,979 | A | 5/1987 | Boehm, Jr. | |
| 4,719,971 | A | 1/1988 | Owens | |
| 4,742,874 | A | 5/1988 | Gullion | |
| 5,067,734 | A | 11/1991 | Boehm, Jr. | |
| 5,285,853 | A * | 2/1994 | Eckert | E21B 33/04 166/382 |
| 5,364,110 | A | 11/1994 | Streich | |
| 5,685,369 | A | 11/1997 | Ellis et al. | |
| 5,735,344 | A | 4/1998 | Duncan | |
| 6,367,558 | B1 | 4/2002 | Borak, Jr. | |
| 7,740,080 | B2 | 6/2010 | Fenton | |
| 8,146,670 | B2 * | 4/2012 | Ellis | E21B 33/04 166/368 |

(Continued)

OTHER PUBLICATIONS

General Electric, "Drilling & Production Systems Surface Wellhead & Tree Technology Update," 2009, 33 pages.

(Continued)

*Primary Examiner* — Cathleen R Hutchins

(74) *Attorney, Agent, or Firm* — Hogan Lovells US LLP

(57) ABSTRACT

An energizing ring for setting a downhole sealing element includes a passage extending through a width of the energizing ring and a wing extending radially outward from a body of the energizing ring, the wing includes a sealing arm coupled to the body at a joint and a slot arranged between at least a portion of the sealing arm and the body, wherein the sealing arm is configured to pivot relative to the joint in response to a fluid pressure within the cavity.

16 Claims, 11 Drawing Sheets

(56) References Cited

U.S. PATENT DOCUMENTS

| | | | | |
|---|---|---|---|---|
| 8,205,670 | B2 | 6/2012 | Nelson | |
| 2003/0080516 | A1 | 5/2003 | Zheng | |
| 2010/0116489 | A1 | 5/2010 | Nelson | |
| 2010/0300705 | A1 | 12/2010 | Nelson | |
| 2011/0120697 | A1* | 5/2011 | Buckle | E21B 33/04 166/75.11 |
| 2014/0131054 | A1* | 5/2014 | Raynal | E21B 33/03 166/387 |

OTHER PUBLICATIONS

International Search Report and Written Opinion dated Jun. 21, 2019 in corresponding PCT Application No. PCT/US19/026358.
International Search Report and Written Opinion dated Jun. 20, 2019 in corresponding PCT Application No. PCT/US19/026282.

* cited by examiner

PRESSURE ENERGIZED SEAL ACTUATOR RING

CROSS REFERENCE TO RELATED APPLICATIONS

This application claims priority to U.S. Provisional Application No. 62/654,010 filed Apr. 6, 2018 titled "PRESSURE ENERGIZED SEAL ACTUATOR RING," the disclosure of which is incorporated herein by reference in its entirety.

BACKGROUND OF THE DISCLOSURE

1. Field of the Disclosure

This disclosure relates in general to oil and gas tools, and in particular, to systems and methods for sealing between components in wellbore operations.

2. Brief Description of Related Art

In oil and gas production, different pieces of equipment may be utilized in a downhole environment in order to establish sections of a wellbore. For example, casing may be installed along an outer circumferential extent of the wellbore and additional equipment, such as hangers and the like, may be installed. The hanger may be used to support wellbore tubulars utilized within the system. In operation, seals may be arranged between the downhole equipment in order to establish a variety of pressure barriers in order to direct fluid into and out of the well along predetermined flow paths. The seals are tested at different stages of wellbore operations in order to verify their integrity. Often, testing may lead to installation of test ports within the components, which may be potential leak paths.

SUMMARY OF THE DISCLOSURE

Applicants recognized the problems noted above herein and conceived and developed embodiments of systems and methods, according to the present disclosure, for coupling auxiliary lines.

In an embodiment, a sealing assembly for use in an oil and gas operation includes a sealing element having a cavity between a first leg and a second leg, the first and second legs coupled together at a bottom of the sealing element and separated at a top by an opening leading to the cavity, and a test port extending through the first leg and the second leg into fluid communication with the cavity. The sealing element also includes an energizing ring adapted for insertion into the cavity, the energizing ring driving the first leg and the second leg in opposite radial directions. The energizing ring includes a passage fluidly coupled to the cavity, the passage extending through a width of the energizing ring. The energizing ring also includes a plurality of wings positioned along an inner diameter and an outer diameter of an energizing ring body, each wing of the plurality of wings including a sealing arm coupled to the energizing ring body at a joint, the sealing arm separated from at least a portion of the energizing ring body by a slot, wherein the respective sealing arms are configured to pivot relative to the joint in response to a fluid introduced into the cavity.

In an embodiment, a wellbore system includes a wellhead housing having a bore, a hanger positioned within the bore, and a sealing assembly arranged between the hanger and the bore to form a fluid seal. The sealing assembly includes a sealing element having a cavity between a first leg and a second leg, the first and second legs coupled together at a bottom of the sealing element and separated at a top by an opening leading to the cavity, and a test port extending through the first leg and the second leg into fluid communication with the cavity. The sealing assembly also includes an energizing ring adapted for insertion into the cavity, the energizing ring driving the first leg and the second leg in opposite radial directions. The energizing ring includes a passage fluidly coupled to the cavity, the passage extending through a width of the energizing ring. The energizing ring also includes a wing extending radially outward from a body of the energizing ring, the wing including a sealing arm coupled to the body at a joint and a slot arranged between at least a portion of the sealing arm and the body, wherein the sealing arm is configured to pivot relative to the joint in response to a fluid pressure within the cavity.

In an embodiment, an energizing ring for setting a downhole sealing element includes a passage extending through a width of the energizing ring and a wing extending radially outward from a body of the energizing ring, the wing includes a sealing arm coupled to the body at a joint and a slot arranged between at least a portion of the sealing arm and the body, wherein the sealing arm is configured to pivot relative to the joint in response to a fluid pressure within the cavity.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE PREFERRED EMBODIMENT

Figure 1:
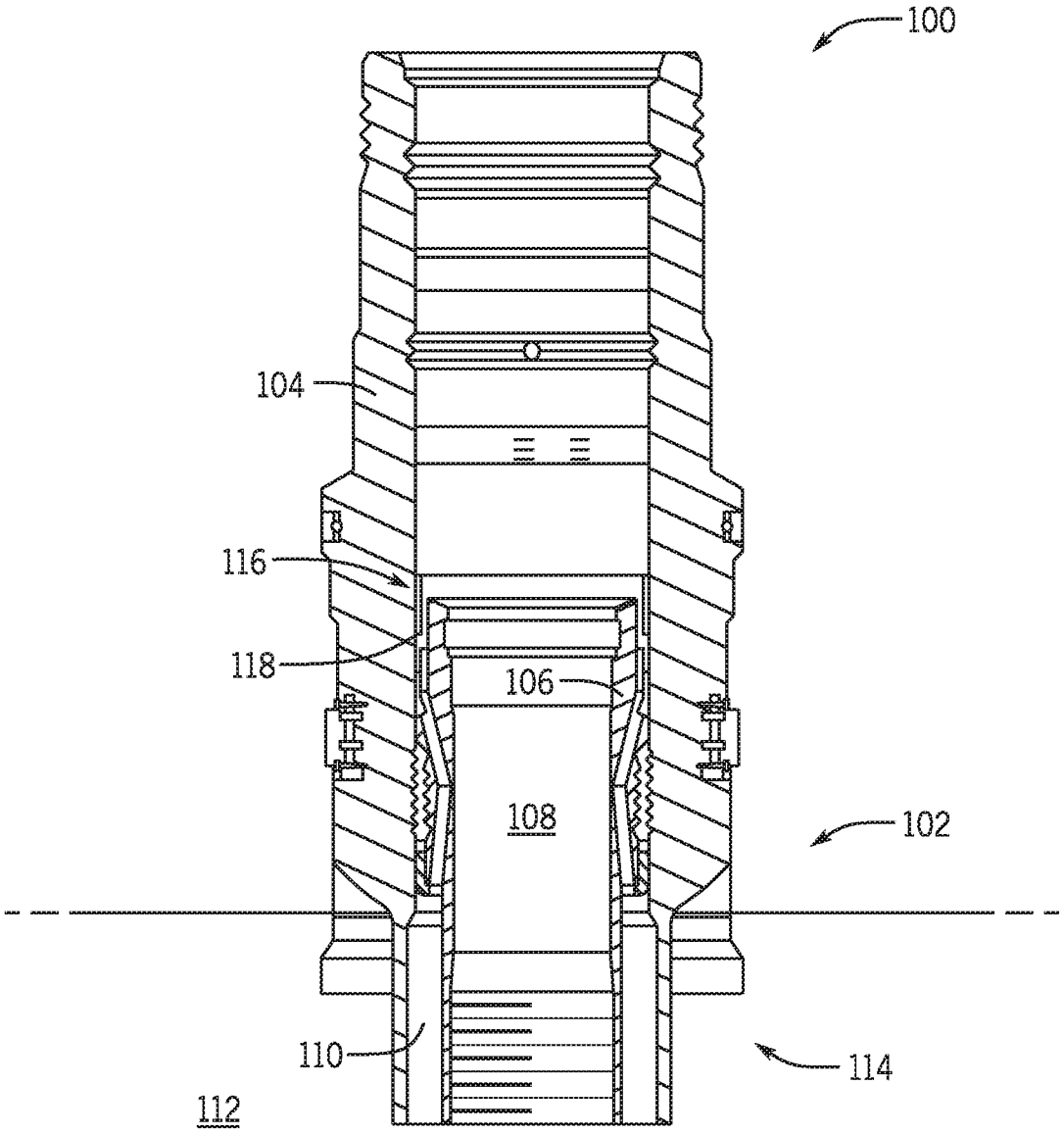
FIG. 1 is a cross-sectional view of an embodiment of a wellhead assembly, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Embodiments of the present disclosure include systems and methods to activate a downhole seal that is pressure energized between a metal-to-metal annular packoff primary sealing element and an actuating energizing ring. In certain embodiments, the actuating energizing ring includes a plurality of wings that are driven radially outward from a body portion, thereby pressing against the primary sealing element with greater force as fluidic pressure is introduced into the body. The force generated by the actuating energizing ring may drive the packoff primary sealing element into the housing and hanger, thereby improving the seal between those components. In various embodiments, the energizing ring may include one or more passages, which may be offset, to facilitate transportation of fluids to different positions proximate the actuating energizing ring.

In various embodiments, a method for generating a pressure energized seal between a metal-to-metal annular packoff primary sealing element and the actuating energizing ring is disclosed. Test pressure between the primary sealing element and the actuating energizing ring generates a pressure energized preload on the sealing feature so that a metal seal can be formed. As the test pressure builds, the sealing contact pressure builds. This method substantially reduces sealing contact pressure to be generated by initial mechanical preload and thus, in turn, required capacities and strength of the tools and the corresponding tool interfaces.

In certain oil and gas operations, a U-cup metal-to-metal annular packoff works by driving a stiff actuating energizing ring into a flexible U-shaped primary sealing element. This plastically deforms the primary sealing element and generates mechanical preload on the sealing surfaces. The mechanical preload is designed to be sufficient to provide enough contact pressure to form a seal. In surfaces applications, it is sometimes desirable to test through the seal to verify that the seal is still functioning as intended. To do this, a port is made through the primary sealing element and through the actuating energizing ring. Introducing this test port means that another seal has to be formed between the primary sealing element and the actuating energizing ring itself. In various embodiments, this sealing contact pressure is formed when the seal is set. However, for high pressure applications, this preload may not be sufficient alone.

To test with higher pressures, sufficient contact pressure is desirable between the primary sealing element inside and the exterior of the actuating energizing ring. Embodiments of the present disclosure illustrate a cantilever sealing arm on the actuating energizing ring that rotates/pivots about a joint located on the main body of the actuating energizing ring. It should be appreciated that, in various embodiments, the rotating and/or pivoting of the joint may be a graduation deflection in a substantially radially outward direction. These sealing arms are orientated such that when pressure hits the containing side, it creates a net force perpendicular to the sealing surface, which generates compression preload on the sealing interface. As the pressure increases, generated load increases, thus allowing a seal to be maintained. In various embodiments, the actuating energizing ring provides enough preload between the sealing arm and the primary sealing element so that an initial seal is formed. Once pressure builds behind it, the pressure generates the full seal to hold back the test pressure.

During field operations for surface wellheads, the wellhead annular seals may be tested from an external port to verify that the seals are still holding full working pressure. To do this, a port is formed between the wellhead housing, through the annular packoff to the hanger, so that the three interfaces can be checked: housing to seal, primary seal element to seal actuating energizing ring, and the seal to hanger. The introduction of the test port through conventional U-cup style annular pack offs means another sealing interface is desirably formed so that a leak path is not introduced. Systems and methods of the present disclosure provide a reliable way of creating that sealing surface.

FIG. 1 is a cross-sectional view of an embodiment of a wellhead assembly 100 that may be used in oil and gas drilling and production operations. It should be appreciated that various components have been removed and/or simplified for clarity and simplicity regarding the discussion herein. The wellhead assembly 100 is arranged at a surface location 102, in the illustrated embodiment, but it should be appreciated that embodiments may also be utilized in subsea applications or applications where the wellhead is below ground. At the surface location 102 sits a wellhead housing 104. Within the wellhead housing 104, in turn, there can typically be positioned a casing hanger 106. From the casing hanger 106 is hung a casing string.

The casing hanger 106 and casing string surround a bore 108. During drilling operations, drilling pipe and tools pass through the casing hanger 106 via the bore 108 toward the bottom of the well. Similarly, during production operations, production piping and tools pass through the casing hanger 106 via the bore 108. The bore 108 contains drilling fluid, or mud, that is designed to control pressure in the well, and carry chips and debris away from the drill bit during drilling operations. The mud within the bore 108 is maintained at an appropriate bore pressure, which varies according to conditions in the well. The area outside the casing hanger 106 and casing string is an annulus 110 which can also contain fluid, such as fluid entering the annulus from the formation 112 through which a bore hole 114 is drilled. The fluid within the annulus 110 has an annular pressure that may be different from the bore pressure within the casing hanger 106, which results in an unbalance force.

An annulus seal assembly 116, including annulus seal 118, is provided between the wellhead housing 104 and the casing hanger 106 to seal the interface therebetween. In order to set, or "energize" the annulus seal 118 into a sealing position, an energizing ring is pushed into the annulus seal 118 to cause the annulus seal to expand outward and to be urged onto both the wellhead housing and the casing hanger, thereby sealing the annulus 110.

It typically requires a large force to energize and set the annulus seal 118. However, there may be limitations to the amount of setting force that can be applied. This may prevent the annulus seal from being optimally energized, and thus decrease the pressure the annulus seal 118 can withstand.

Figure 2:
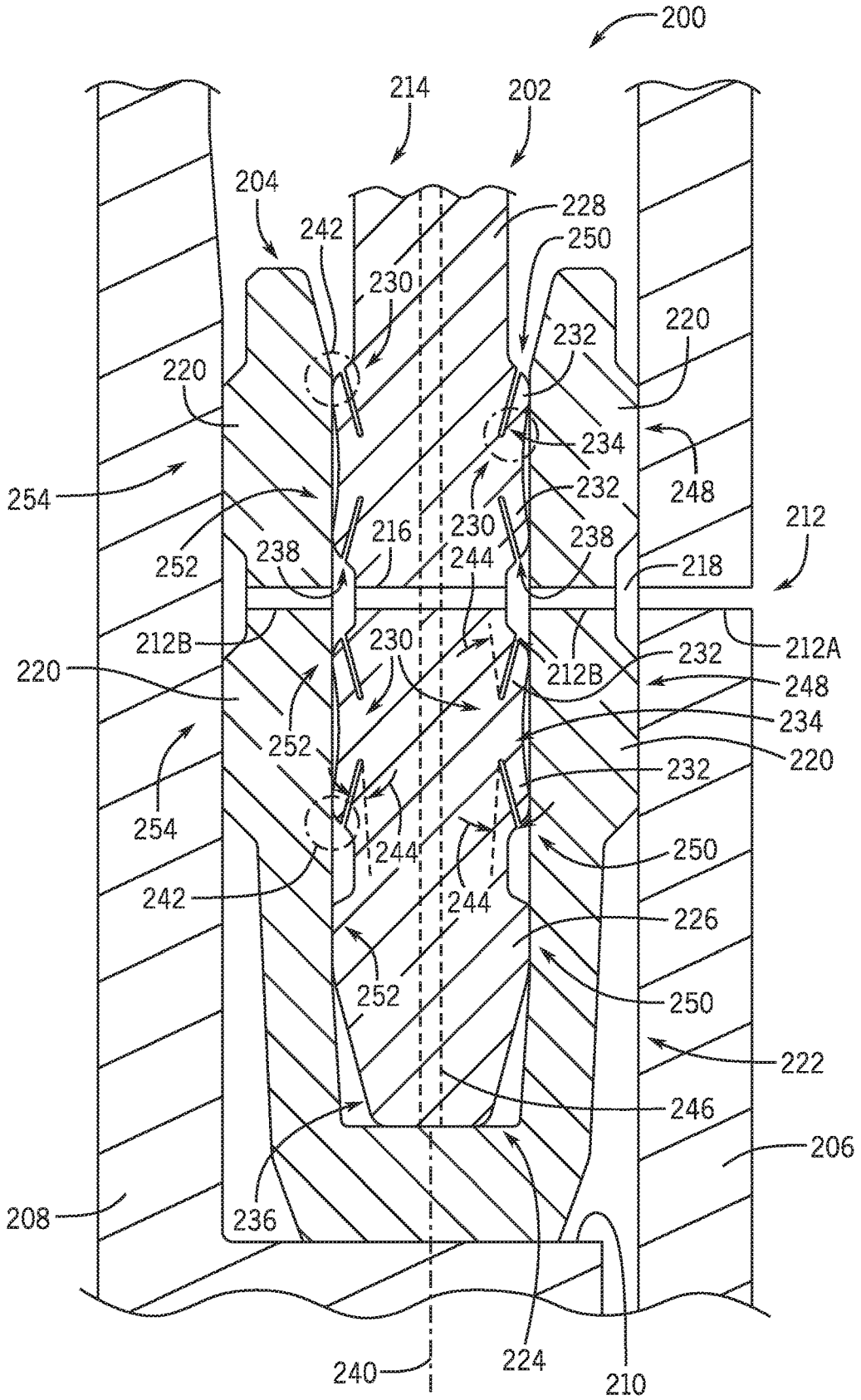
FIG. 2 is a schematic cross-sectional view of an embodiment of a seal assembly, in accordance with embodiments of the present disclosure.

FIG. 2 is a schematic cross-sectional view of an embodiment of a seal assembly 200. In the illustrated embodiment, an actuating energizing ring 202 (e.g., energizing ring) is arranged within a primary seal 204 (e.g., primary sealing element), which may also be referred to as a U-cup seal. It should be appreciated that the seal assembly 200 may be utilized in a downhole environment, such as with the wellhead assembly 100 illustrated in FIG. 1. The illustrated seal assembly 200 is arranged between a wellhead housing 206 and a hanger 208 such that the primary seal 204 is seated on a shoulder 210. It should be appreciated that the shoulder 210 is for illustrative purposes and that, in other embodiments, different retention members and the like may be utilized to position the seal 204 in place.

As described above, in various embodiments the seal assembly 200 may be tested, for example via a test port 212 that extends through the wellhead housing 206 into a pocket 214 formed between the wellhead housing 206 and the hanger 208. The test port 212 may be utilized to record a pressure reading and/or to introduce working fluids into the pocket 214. In the illustrated embodiment, the test port 212 further extends through the primary seal 204 and into alignment with a passage 216 formed through the energizing ring 202. It should be appreciated that the test port 212 may be referred to as a single flow path or as a first test port 212A formed within the wellhead housing 206 and a second test port 212B formed within the primary seal 204.

In the illustrated embodiment, the test port 212 is aligned with the passage 216, however, it should be appreciated that the test port 212 and the passage 216 may not be aligned. A void 218 is arranged radially outward of the primary seal 204 (for example, between the illustrated extensions 220) and enable fluid communication between the first test port 212A and the second test port 212B. When the primary seal 204 is set, the void 218 may not be in fluid communication with the pocket 214 at axially lower and higher positions (e.g., lower and higher than the extensions 220, respectively). In other words, the void 218 may be isolated via contact between the extensions 220 and the hanger 208 and wellhead housing 206, respectively.

In the illustrated embodiment, the actuating energizing ring 202 includes the first end 222 with the reduced diameter portion 224 that is substantially angled or slopes outwardly to a head portion 226, the head portion 226 being wider than the first end 222. Furthermore, a body portion 228 of the actuating energizing ring 202 includes a plurality of wings 230, in the illustrated embodiment, formed by a plurality of cantilevered sealing arms 232 that pivot or rotate about a respective joint 234. In various embodiments, the movement of the sealing arms 232 about and/or relative to the joint 234 may be gradual and may also be referred to as a deflection. As fluid is introduced into a cavity 236 of the primary seal 204 (e.g., the area where the energizing ring 202 is positioned), the fluid will be directed toward slots 238 proximate the wings 230, which will drive the arms 232 radially outward with respect to an axis 240 to press against the primary sealing element 204 at a respective contact point 242. In the illustrated embodiment, the slots 238 in direct fluid communication with the cavity 236. As a result, the sealing arms 232 may be described as being coupled to the body portion 228 at one end (e.g., proximate the joint 234) and free at a second end, which forms the opening into the slots 238. As fluid pressure increases, so does the pressure of the sealing arms 232 against the primary sealing element 204, which improves the seal. The illustrated wings 230 are arranged at angles 244 with respect to the axis 240, however it should be appreciated that the wings 230 may be substantially parallel to the axis 240.

In the illustrated embodiment, there are a total of 8 sealing arms 232, however, it should be appreciated that in various embodiments there may be more or fewer sealing arms 232. Furthermore, half of the sealing arms 232 are pointed substantially uphole and half of the sealing arms 232 are pointed substantially downhole. It should be appreciated that this arrangement is for illustrative purposes only and that any configuration or arrangement may be used.

The illustrated actuating energizing ring 202 further includes a longitudinal flow path 246 (illustrated with broken lines) that is off-center from the passage 216. In other words, the longitudinal flow path 246 and the passage do not intersect 216. In various embodiments, the cavity 236 may be filled with fluid as the actuating energizing ring 202 is installed, the longitudinal flow path 246 serves to direct the fluid out of the cavity 236 to enable installation of the actuating energizing ring 202.

In operation, the energizing ring 202 is installed within the cavity 236 to preload the primary seal 204, for example, driving the extensions 220 radially outward from the axis 240 to form a seal between the wellhead housing 206 and the hanger 208. Such an arrangement generates four different general force interfaces. A first force interface 248 is between the primary seal 204 and the wellhead housing 206. A second force interface 250 is between the primary seal 204 and the energizing ring 202 at a radially outward position relative to the axis 240. A third force interface 252 is between the primary seal 204 and the energizing ring 202 at a radially inward position relative to the axis 240. A fourth force interface 254 is between the primary seal 204 and hanger 208. As noted above, when pressure testing occurs, leak paths may be generated, and as a result, the fluid may be utilized to generate the seal. As the fluid enters the cavity 236, via the void 218 and the second test port 212B, the fluid may enter the slots 238, which drives the arms 230 radially away from the body portion 228. As fluid pressure increases, additional force is applied to the arms 230, which may further deform or drive the primary seal 204 radially outward and into the wellhead housing 206 and hanger 208, respectively. In this manner, the force interfaces are maintained via the fluid pressure driving the arms 230 radially outward. Furthermore, as noted above, initial preload forces may be decreased because subsequent introduction of fluid pressure will facilitate further deformation of the primary seal 204.

Figure 3B:
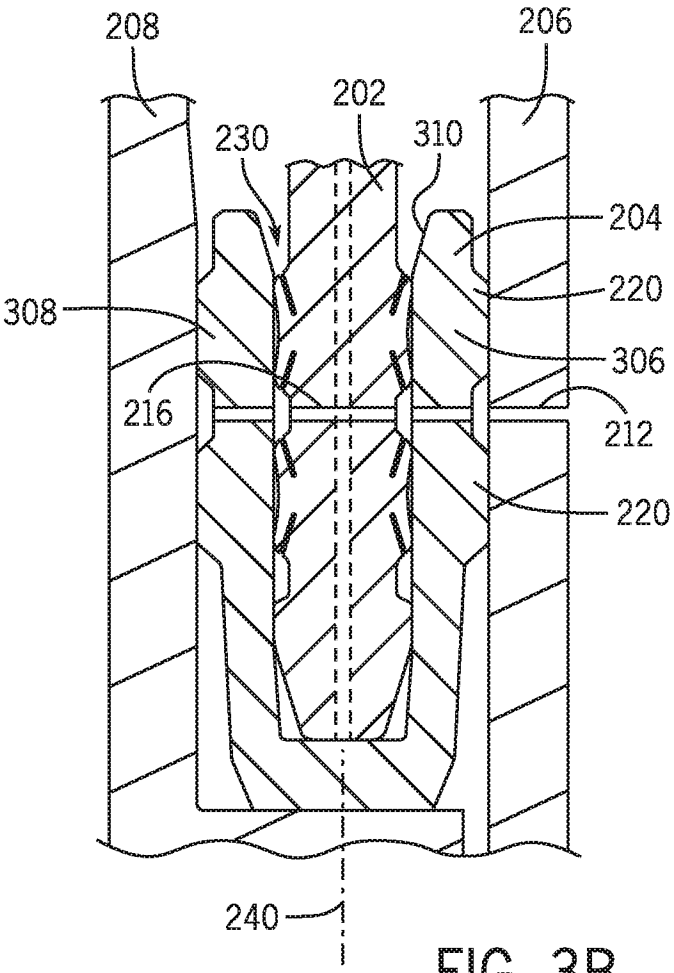
FIG. 3B is a schematic cross-sectional view of an energizing ring of a seal assembly positioned within a primary seal cavity, in accordance with embodiments of the present disclosure.
Figure 3A:
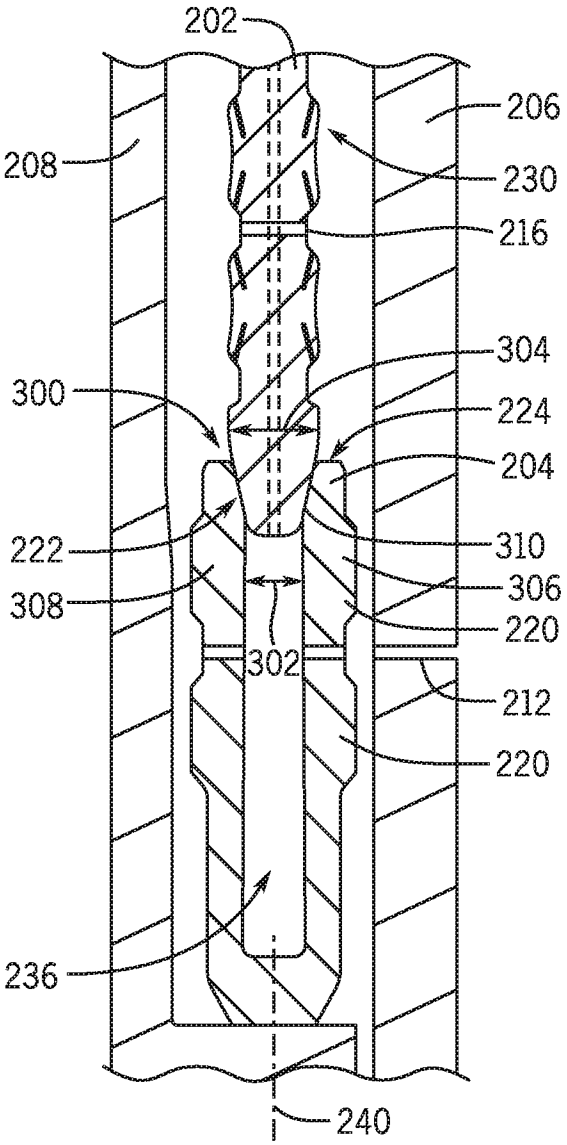
FIG. 3A is a schematic cross-sectional view of an embodiment of an energizing ring of a seal assembly positioned proximate a primary seal opening, in accordance with embodiments of the present disclosure.

FIGS. 3A and 3B are cross-sectional side views of a sequence of installation of the energizing ring 202 within the primary seal 204. FIG. 3A illustrates the energizing ring 202 entering an opening 300 of the primary seal 204 leading to the cavity 236. In various embodiments, the primary sealing element 204 may be activated, for example via a mechanical force, to drive radially outward and into engagement with the hanger 208 and the housing 206, thereby forming a mechanical seal between the components As shown, a width 302 of the cavity 236 is less than a width 304 of the actuating energizing ring 202, and as a result, the actuating energizing ring 202 will drive arms 306, 308 of the substantially U-shaped primary sealing element 204 radially about and away from the axis 240. In the illustrated embodiment, the primary sealing element 204 includes the extensions 220, illustrated as a plurality of ridges along radially outside edges of each arm 306, 308. It should be appreciated that the extensions 220 are for illustrative purposes only and are not intended to limit embodiments of the present disclosure, as there may be more or fewer and they may be differently shaped.

The actuating energizing ring 202 includes the first end 222 having the reduced diameter portion 224 to thereby facilitate alignment with the opening 300 to the cavity 236 of the primary sealing element 204. In various embodiments, the opening 300 may include a sloped or angled surface 310 to direct the actuating energizing ring into the cavity. FIG. 3B illustrates the actuating energizing ring 202 installed within the cavity 236 and driving the arms 306, 308 radially outward and into contact with the hanger 208 and the wellhead housing 206. As shown, the actuating energizing ring 202 deforms the primary sealing element 204 to form the seal between the hanger 208 and the housing 206.

FIGS. 3A and 3B further illustrate the test port 212 that extends through the housing 206 and the primary seal 204. In operation, as fluid is introduced through the test port 212, the fluid may pass through the actuating energizing ring 202 (for example, via the passage 216), which facilitates directing the fluid annularly around the actuating energizing ring 202. As a result, the fluid may interact with one or more of the wings 230 to facilitate the formation of the seal.

Figure 4:
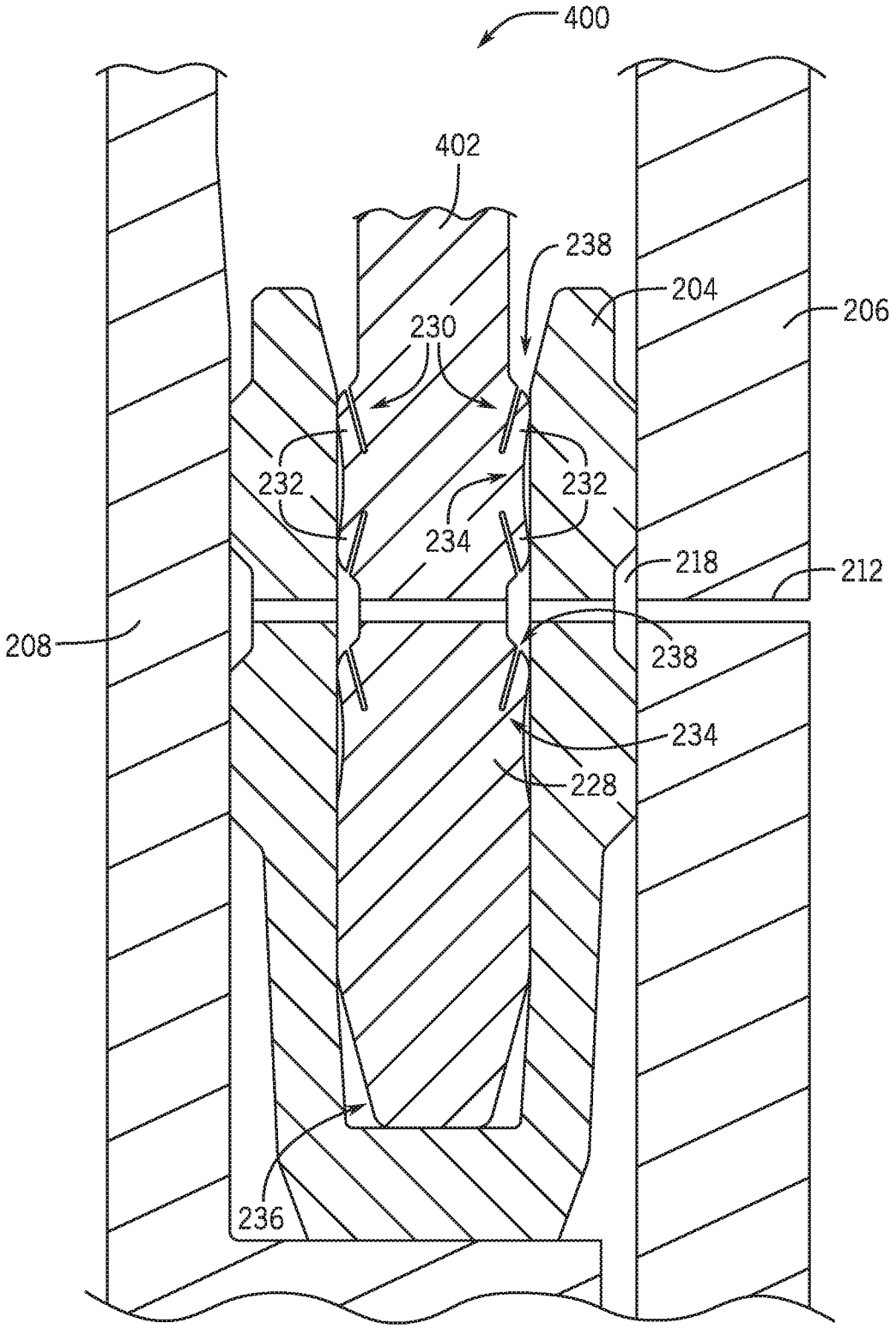
FIG. 4 is a schematic cross-sectional view of an embodiment of a seal assembly, in accordance with embodiments of the present disclosure.

FIG. 4 is a schematic cross-sectional view of an embodiment of a seal assembly 400 including an actuating energizing ring 402 and the primary seal 204. It should be appreciated that the actuating energizing ring 402 may share several features with the actuating energizing ring 202, described above. For example, in the illustrated embodiment, the actuating energizing ring 402 has a reduced number of wings 230 and does not include the longitudinal flow path 246 illustrated in FIG. 2. In operation, as described above, introduction of fluid into the cavity 236 will drive sealing arms 232 radially outward toward the wellhead housing 206 and hanger 208, respectively. For example, the fluid may enter the cavity 236 via the test port 212 and the void 218. As the fluid enters the slots 238, arranged between the arms 232 and the body portion 228, the arms 232 rotate and/or pivot about respective joints 234, as described above. For example, the movement of the arms 232 may be a gradual deflection that is substantially radially outward from the body 228. As the pressure of the fluid increases, so will the force applied to the primary sealing element 204, thereby improving the sealing properties between the actuating energizing ring 402 and the primary sealing element 204.

Figure 5B:
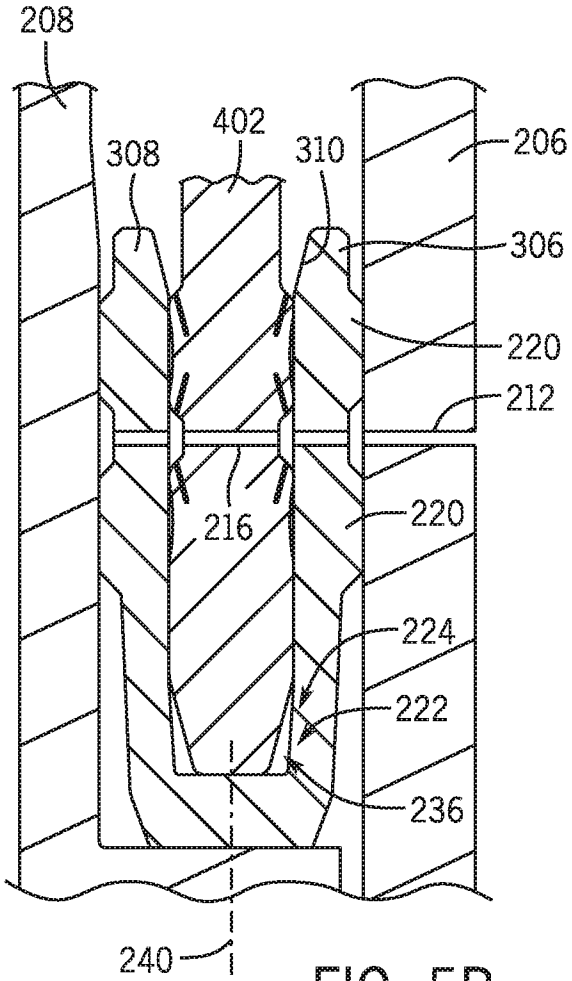
FIG. 5B is a schematic cross-sectional view of an energizing ring of a seal assembly positioned within a primary seal cavity, in accordance with embodiments of the present disclosure.
Figure 5A:
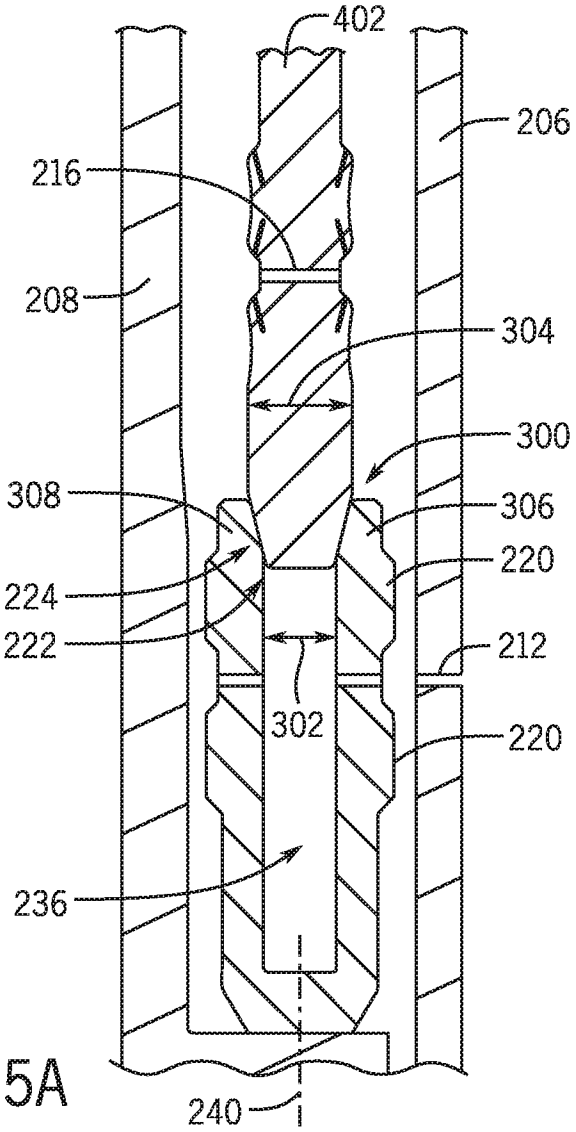
FIG. 5A is a schematic cross-sectional view of an embodiment of an energizing ring of a seal assembly positioned proximate a primary seal opening, in accordance with embodiments of the present disclosure.

FIGS. 5A and 5B are cross-sectional side views of a sequence of installation of the energizing ring 402 within the primary seal 204. FIG. 5A illustrates the energizing ring 402 entering the opening 300 of the primary seal 204 leading to the cavity 236.

As shown, the width 302 of the cavity 236 is less than the width 304 of the actuating energizing ring 402, and as a result, the actuating energizing ring 402 will drive arms 306, 308 of the substantially U-shaped primary sealing element 204 radially about and away from the axis 240. In the illustrated embodiment, the primary sealing element 204 includes the extensions 220, illustrated as a plurality of ridges along radially outside edges of each arm 306, 308. It should be appreciated that the extensions 220 are for illustrative purposes only and are not intended to limit embodiments of the present disclosure, as there may be more or fewer and they may be differently shaped.

The actuating energizing ring 402 includes the first end 222 having the reduced diameter portion 224 to thereby facilitate alignment with the opening 300 to the cavity 236 of the primary sealing element 204. In various embodiments, the opening 300 may include a sloped or angled surface 310 to direct the actuating energizing ring into the cavity. FIG. 5B illustrates the actuating energizing ring 402 installed within the cavity 236 and driving the arms 306, 308 radially outward and into contact with the hanger 208 and the wellhead housing 206. As shown, the actuating energizing ring 402 deforms the primary sealing element 204 to form the seal between the hanger 208 and the housing 206.

FIGS. 5A and 5B further illustrate the test port 212 that extends through the housing 206 and the primary seal 204. In operation, as fluid is introduced through the test port 212, the fluid may pass through the actuating energizing ring 402 (for example, via the passage 216), which facilitates directing the fluid annularly around the actuating energizing ring 202. As a result, the fluid may interact with one or more of the wings 230 to facilitate the formation of the seal.

Figure 6:
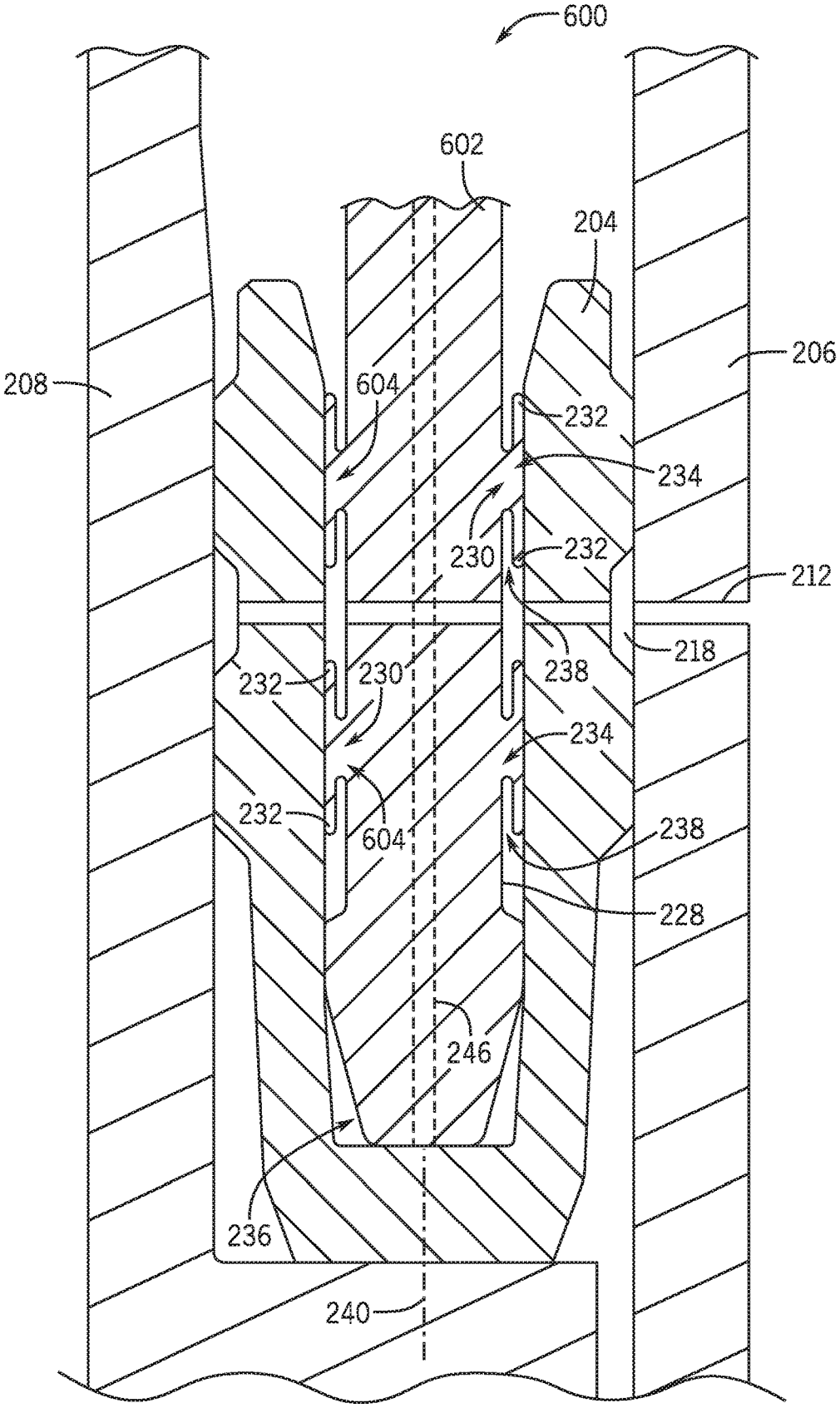
FIG. 6 is a schematic cross-sectional view of an embodiment of a seal assembly, in accordance with embodiments of the present disclosure.

FIG. 6 is a schematic cross-sectional view of an embodiment of a seal assembly 600 including an actuating energizing ring 602 and the primary seal 204. It should be appreciated that the actuating energizing ring 602 may share several features with the actuating energizing ring 202, described above. For example, in the illustrated embodiment, the actuating energizing ring 602 includes the wings 230, however, the sealing arms 232 are arranged substantially parallel to the axis 240. For example, the illustrated wing 230 may be formed by the sealing arms 232 arranged on respective protrusions 604 that extend radially outward from the body portion 228. In the illustrated embodiment, each of the wings 230 includes tow sealing arms 232 coupled to a common protrusion 604. However, as noted above, the presence of the protrusion 604 does not eliminate the slots 238, which facilitate fluid pressure driving the sealing arms 232 about the respective joints 234.

In operation, as described above, introduction of fluid into the cavity 236 will drive sealing arms 232 radially outward toward the wellhead housing 206 and hanger 208, respectively. For example, the fluid may enter the cavity 236 via the test port 212 and the void 218. As the fluid enters the slots 238, arranged between the arms 232 and the body portion 228, the arms 232 rotate and/or pivot about respective joints 234, as described above. As the pressure of the fluid increases, so will the force applied to the primary sealing element 204, thereby improving the sealing properties between the actuating energizing ring 402 and the primary sealing element 204.

In the illustrated embodiment, there are a total of 8 sealing arms 232, however, it should be appreciated that in various embodiments there may be more or fewer sealing arms 232. Furthermore, half of the sealing arms 232 are pointed substantially uphole and half of the sealing arms 232 are pointed substantially downhole. That is, the openings of the slots 238 are substantially facing the uphole and downhole directions. It should be appreciated that this arrangement is for illustrative purposes only and that any configuration or arrangement may be used. For example, in various embodiments a portion of the arms 232 may be substantially parallel to the axis 240, as illustrated in FIG. 6, while a portion of the arms 232 may be arranged at the angle 244, as illustrated in FIGS. 2 and 4. Accordingly, it should be appreciated that features of embodiment described herein may be mixed and matched to provide improved sealing.

The illustrated actuating energizing ring 602 further includes the longitudinal flow path 246 (illustrated with broken lines) that is off-center from the passage 216. In other words, the longitudinal flow path 246 and the passage do not intersect 216. In various embodiments, the cavity 236 may be filled with fluid as the actuating energizing ring 202 is installed, the longitudinal flow path 246 serves to direct the fluid out of the cavity 236 to enable installation of the actuating energizing ring 602.

Figure 7B:
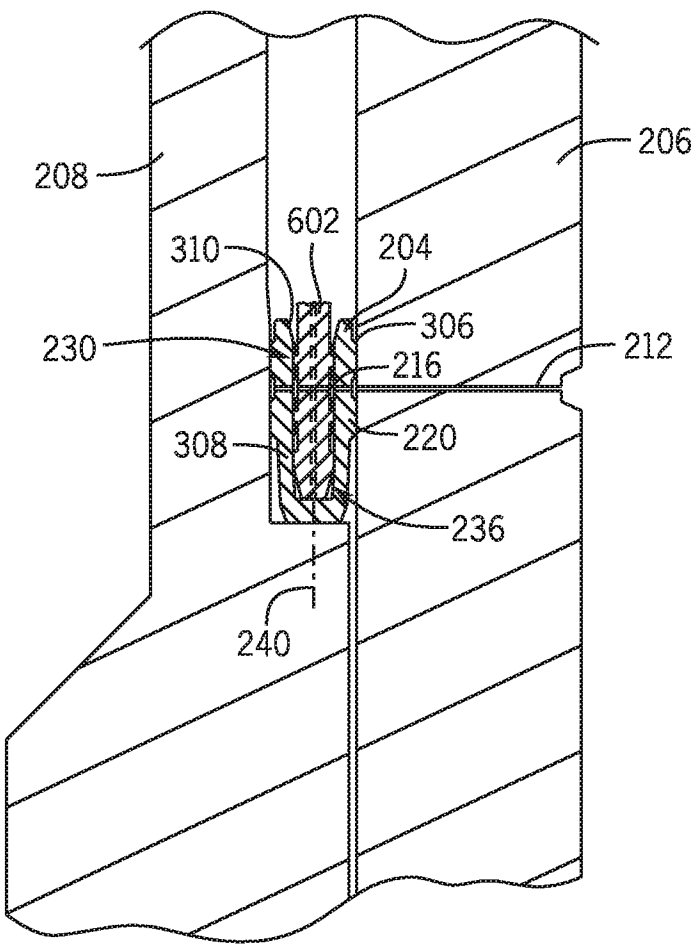
FIG. 7B is a schematic cross-sectional view of an energizing ring of a seal assembly positioned within a primary seal cavity, in accordance with embodiments of the present disclosure.
Figure 7A:
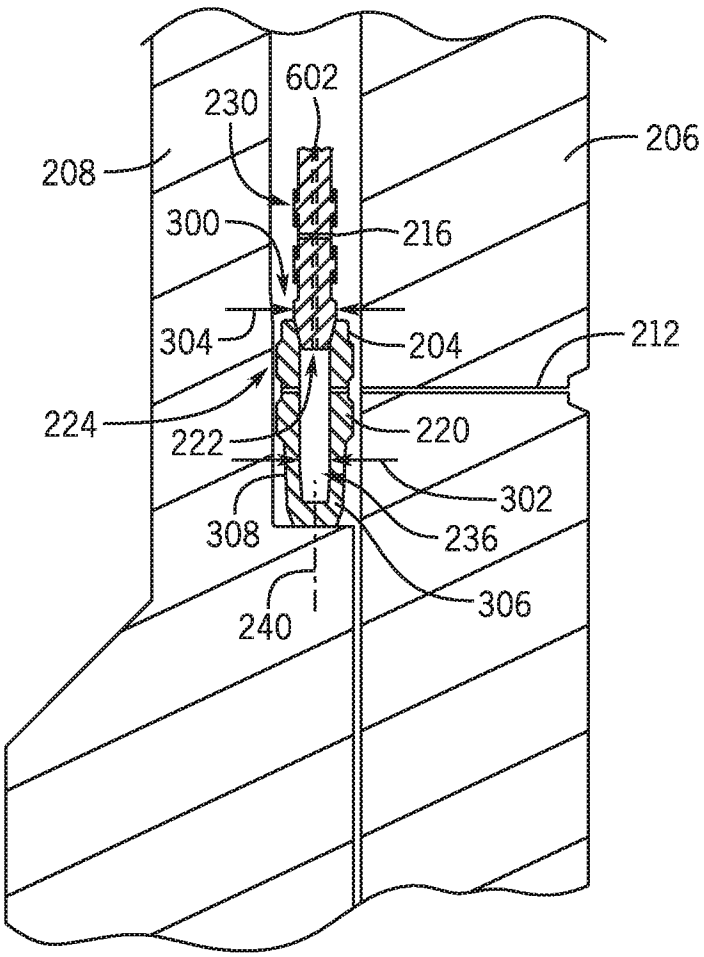
FIG. 7A is a schematic cross-sectional view of an embodiment of an energizing ring of a seal assembly positioned proximate a primary seal opening, in accordance with embodiments of the present disclosure.

FIGS. 7A and 7B are cross-sectional side views of a sequence of installation of the energizing ring 602 within the primary seal 204. FIG. 7A illustrates the energizing ring 602 entering the opening 300 of the primary seal 204 leading to the cavity 236.

As shown, the width 302 of the cavity 236 is less than the width 304 of the actuating energizing ring 602, and as a result, the actuating energizing ring 602 will drive arms 306, 308 of the substantially U-shaped primary sealing element 204 radially about and away from the axis 240. In the illustrated embodiment, the primary sealing element 204 includes the extensions 220, illustrated as a plurality of ridges along radially outside edges of each arm 306, 308. It should be appreciated that the extensions 220 are for illustrative purposes only and are not intended to limit embodiments of the present disclosure, as there may be more or fewer and they may be differently shaped.

The actuating energizing ring 602 includes the first end 222 having the reduced diameter portion 224 to thereby facilitate alignment with the opening 300 to the cavity 236 of the primary sealing element 204. In various embodiments, the opening 300 may include a sloped or angled surface 310 to direct the actuating energizing ring into the cavity. FIG. 7B illustrates the actuating energizing ring 602 installed within the cavity 236 and driving the arms 306, 308 radially outward and into contact with the hanger 208 and the wellhead housing 206. As shown, the actuating energizing ring 602 deforms the primary sealing element 204 to form the seal between the hanger 208 and the housing 206.

FIGS. 7A and 7B further illustrate the test port 212 that extends through the housing 206 and the primary seal 204. In operation, as fluid is introduced through the test port 212, the fluid may pass through the actuating energizing ring 602 (for example, via the passage 216), which facilitates directing the fluid annularly around the actuating energizing ring 202. As a result, the fluid may interact with one or more of the wings 230 to facilitate the formation of the seal.

Figure 8:
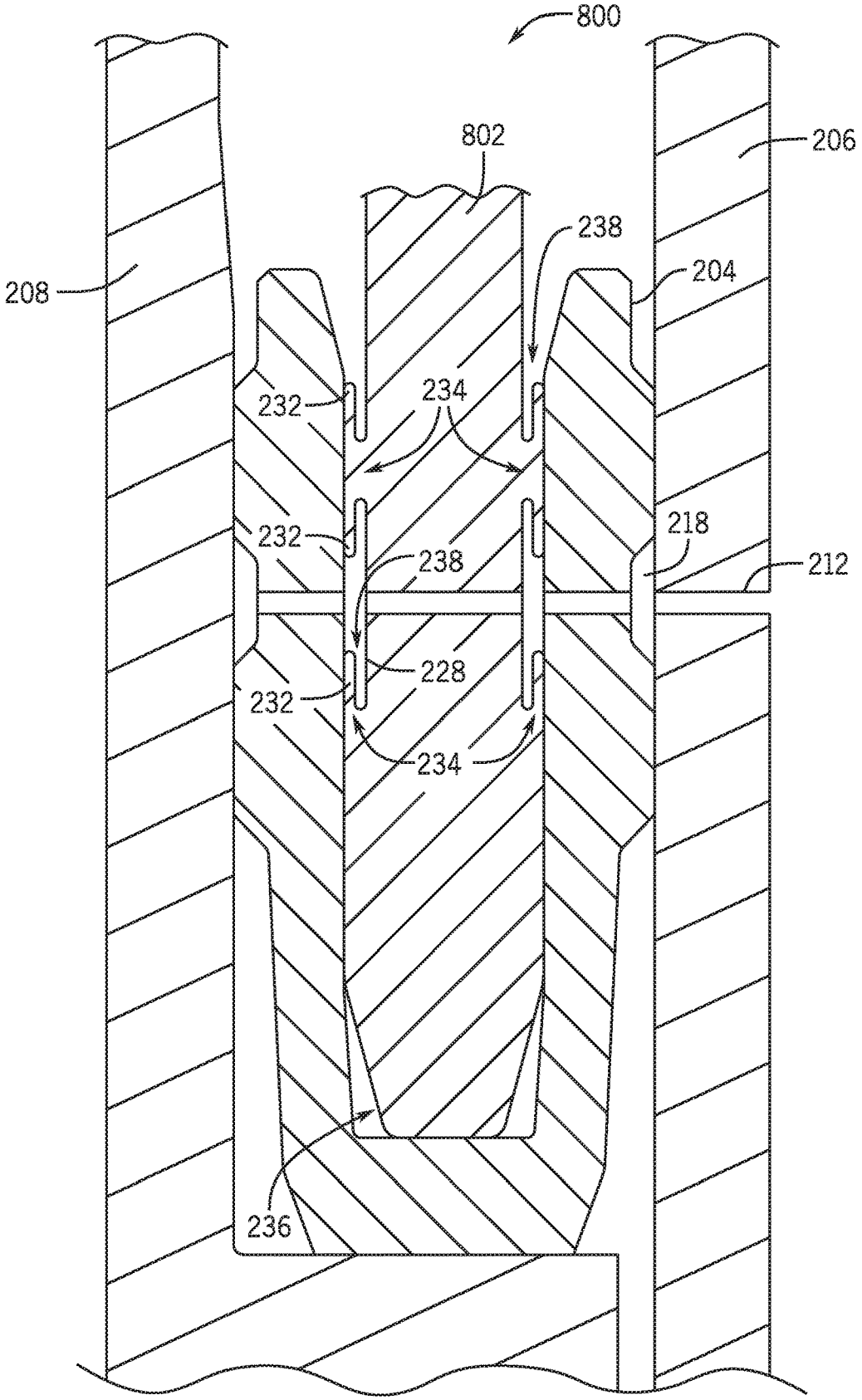
FIG. 8 is a schematic cross-sectional view of an embodiment of a seal assembly, in accordance with embodiments of the present disclosure.

FIG. 8 is a schematic cross-sectional view of an embodiment of a seal assembly 800 including an actuating energizing ring 802 and the primary seal 204. It should be appreciated that the actuating energizing ring 802 may share several features with the actuating energizing ring 202, described above. For example, in the illustrated embodiment, the actuating energizing ring 802 has a reduced number of wings 230 and does not include the longitudinal flow path 246 illustrated in FIG. 6. In operation, as described above, introduction of fluid into the cavity 236 will drive sealing arms 232 radially outward toward the wellhead housing 206 and hanger 208, respectively. For example, the fluid may enter the cavity 236 via the test port 212 and the void 218. As the fluid enters the slots 238, arranged between the arms 232 and the body portion 228, the arms 232 rotate and/or pivot about respective joints 234, as described above. As the pressure of the fluid increases, so will the force applied to the primary sealing element 204, thereby improving the sealing properties between the actuating energizing ring 802 and the primary sealing element 204.

Figure 9B:
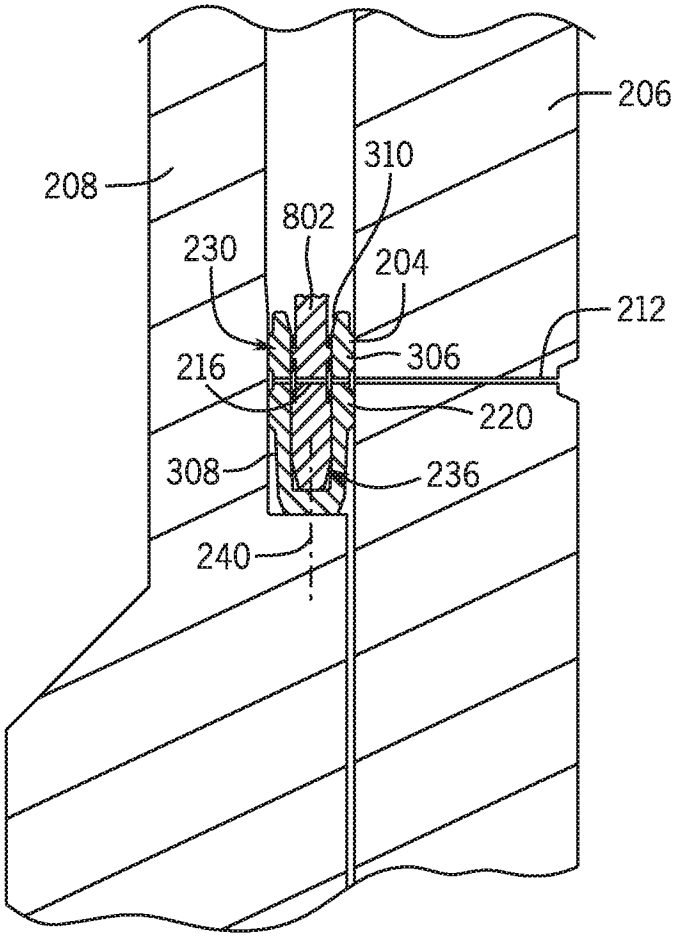
FIG. 9B is a schematic cross-sectional view of an energizing ring of a seal assembly positioned within a primary seal cavity, in accordance with embodiments of the present disclosure.
Figure 9A:
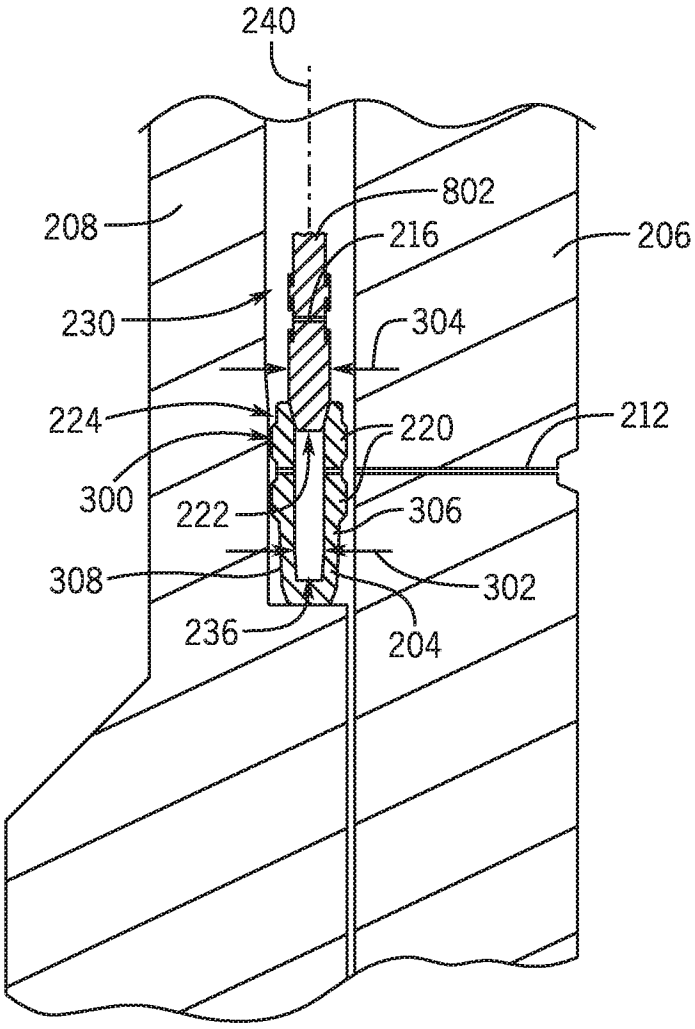
FIG. 9A is a schematic cross-sectional view of an embodiment of an energizing ring of a seal assembly positioned proximate a primary seal opening, in accordance with embodiments of the present disclosure.

FIGS. 9A and 9B are cross-sectional side views of a sequence of installation of the energizing ring 802 within the primary seal 204. FIG. 9A illustrates the energizing ring 802 entering the opening 300 of the primary seal 204 leading to the cavity 236.

As shown, the width 302 of the cavity 236 is less than the width 304 of the actuating energizing ring 402, and as a result, the actuating energizing ring 802 will drive arms 306, 308 of the substantially U-shaped primary sealing element 204 radially about and away from the axis 240. In the illustrated embodiment, the primary sealing element 204 includes the extensions 220, illustrated as a plurality of ridges along radially outside edges of each arm 306, 308. It should be appreciated that the extensions 220 are for illustrative purposes only and are not intended to limit embodiments of the present disclosure, as there may be more or fewer and they may be differently shaped.

The actuating energizing ring 802 includes the first end 222 having the reduced diameter portion 224 to thereby facilitate alignment with the opening 300 to the cavity 236 of the primary sealing element 204. In various embodiments, the opening 300 may include a sloped or angled surface 310 to direct the actuating energizing ring into the cavity. FIG. 5B illustrates the actuating energizing ring 802 installed within the cavity 236 and driving the arms 306, 308 radially outward and into contact with the hanger 208 and the wellhead housing 206. As shown, the actuating energizing ring 802 deforms the primary sealing element 204 to form the seal between the hanger 208 and the housing 206.

FIGS. 9A and 9B further illustrate the test port 212 that extends through the housing 206 and the primary seal 204. In operation, as fluid is introduced through the test port 212, the fluid may pass through the actuating energizing ring 802 (for example, via the passage 216), which facilitates directing the fluid annularly around the actuating energizing ring 202. As a result, the fluid may interact with one or more of the wings 230 to facilitate the formation of the seal.

Figure 10:
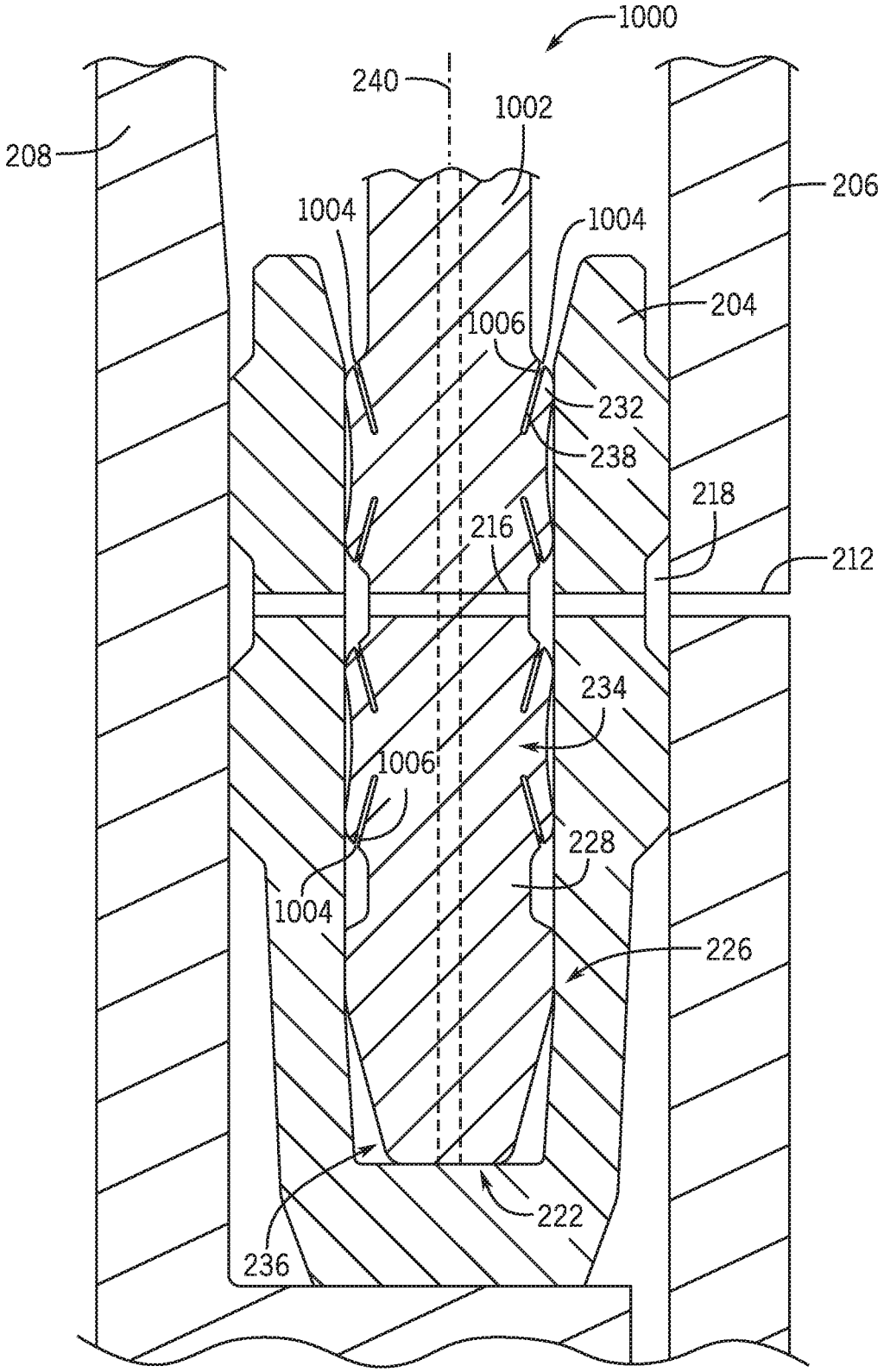
FIG. 10 is a schematic cross-sectional view of an embodiment of a seal assembly, in accordance with embodiments of the present disclosure.

FIG. 10 is a schematic cross-sectional view of an embodiment of a seal assembly 1000 including an actuating energizing ring 1002 and the primary seal 204. It should be appreciated that the actuating energizing ring 1002 may share several features with the actuating energizing ring 202, described above. For example, the illustrated actuating energizing ring 1002 includes the passage 216, first end 222, head portion 226, body portion 228, and the like as illustrated in FIG. 2. Moreover, in the illustrated embodiment, the slots 238 are directly open to the cavity 236 via flow passages 1004 formed in the inserts 1006. That is, in various embodiments, the inserts 1006 may include the flow passages 1004 that fluidly couple the slots 238 to the cavity 236.

The illustrated inserts 1006 may be utilized to drive the sealing arms 232 radially outward from the axis 240 prior to installation into the energizing ring 202. In other words, the inserts 1006 may be used to provide a mechanical support to the sealing arms 232. As the seal is energized, the sealing arms 232 may cantilever towards the body portion 228. In various embodiments described herein (e.g., FIG. 2, FIG. 4, FIG. 6, FIG. 8, etc.) the stiffness of the sealing arms 232 may be sufficiently supportive to provide initial sealing contact. However, the inserts 1006 illustrated in FIG. 10 provide an alternative, or cumulative, method to ensure that sufficient preload is provided to the sealing surfaces at the end of the sealing arms 232, to provide initial sealing contact.

As described above, in various embodiments, the movement of the arms 232 may be a gradual deflection, which may also be described as a bulging or swelling. As a result, the wings 230 may bulge radially outward toward the primary seal 204 to facilitate formation of the seal, as described above.

In embodiments, the inserts 1006 may be removable from the slots 238 and be separately installed within the slots 238. As a result, some slots 238 may include the inserts 1006 while others slots 238 do not. In various embodiments, the inserts 1006 are installed into the opening between the slot 238 and the cavity 236 to block or restrict flow into and out of the slots 238 via the opening proximate the cavity 236. For example, a cross-sectional flow area of the flow passage 1004 may be less than a cross-sectional flow area of the slots 238, thereby restricting flow. Furthermore, while the illustrated embodiment includes the flow passages 1004 substantially aligned with the slots 238, in various embodiments the flow passages 1204 may not be aligned with the slots 238.

In operation, as described above, introduction of fluid into the cavity 236 will drive sealing arms 232 radially outward toward the wellhead housing 206 and hanger 208, respectively. For example, the fluid may enter the cavity 236 via the test port 212 and the void 218. As the fluid enters the slots 238, via the passages 1004, the arms 232 rotate and/or pivot about respective joints 234. As the pressure of the fluid increases, so will the force applied to the primary sealing element 204, thereby improving the sealing properties between the actuating energizing ring 1002 and the primary sealing element 204.

Figure 11:
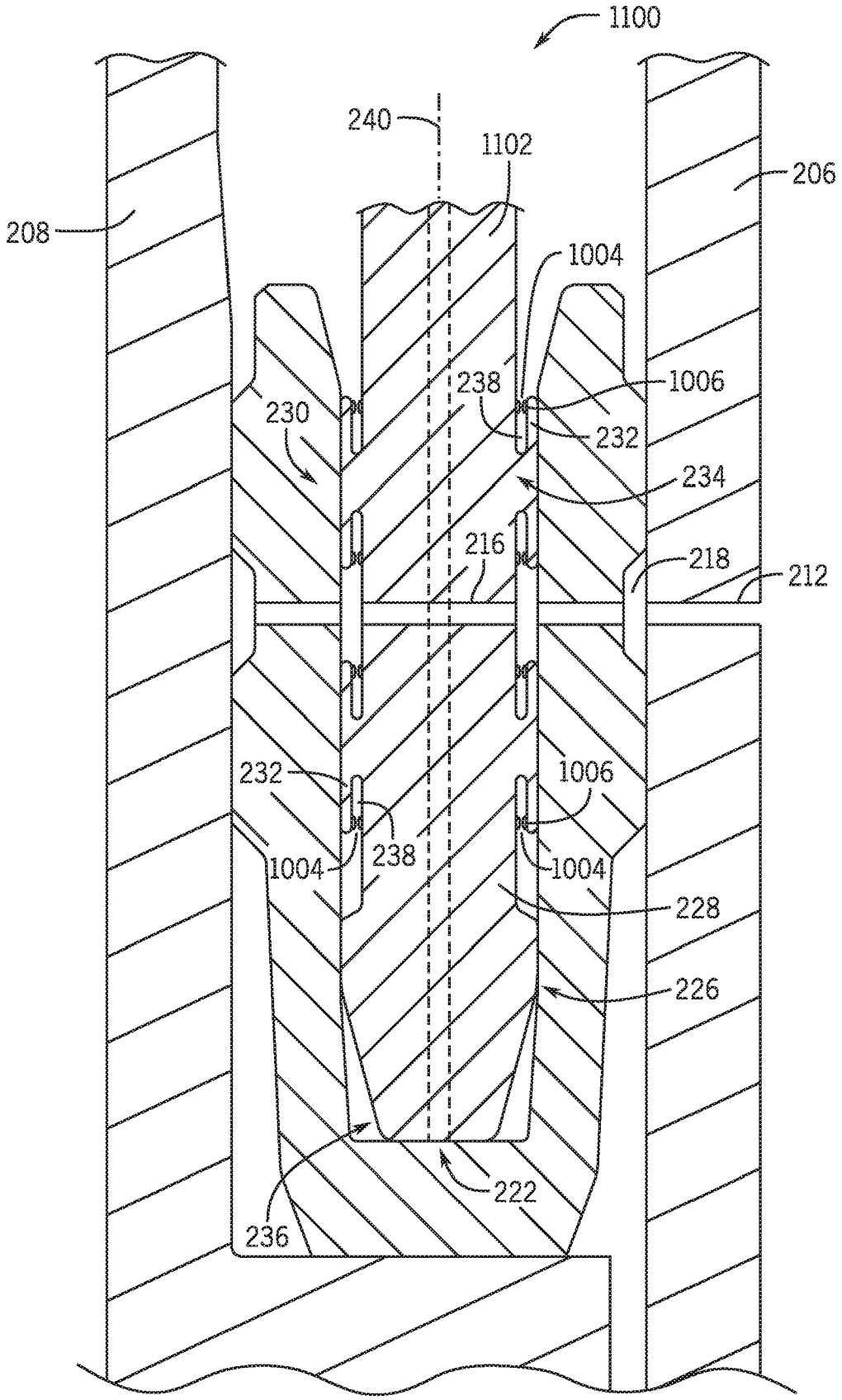
FIG. 11 is a schematic cross-sectional view of an embodiment of a seal assembly, in accordance with embodiments of the present disclosure.

FIG. 11 is a schematic cross-sectional view of an embodiment of a seal assembly 1100 including an actuating energizing ring 1102 and the primary seal 204. It should be appreciated that the actuating energizing ring 1102 may share several features with the actuating energizing ring 202 and/or the actuating energizing ring 602 described above. For example, the illustrated actuating energizing ring 1102 includes the passage 216, first end 222, head portion 226, body portion 228, and the like as illustrated in FIGS. 2 and 6. Moreover, in the illustrated embodiment, the slots 238 are directly open to the cavity 236 via flow passages 1004 formed in the inserts 1006. That is, in various embodiments, the inserts 1006 may include the flow passages 1004 that fluidly couple the slots 238 to the cavity 236.

The illustrated inserts 1006 may be utilized to drive the sealing arms 232 radially outward from the axis 240 prior to installation into the energizing ring 202. In other words, the inserts 1006 may be used to provide a mechanical support to the sealing arms 232. As the seal is energized, the sealing arms 232 may cantilever towards the body portion 228. In various embodiments described herein, the stiffness of the sealing arms 232 may be sufficiently supportive to provide initial sealing contact. However, the inserts 1006 illustrated in FIG. 11 provide an alternative, or cumulative, method to ensure that sufficient preload is provided to the sealing surfaces at the end of the sealing arms 232, to provide initial sealing contact.

As described above, in various embodiments, the movement of the arms 232 may be a gradual deflection, which may also be described as a bulging or swelling. As a result, the wings 230 may bulge radially outward toward the primary seal 204 to facilitate formation of the seal, as described above.

In embodiments, the inserts 1006 may be removable from the slots 238 and be separately installed within the slots 238. As a result, some slots 238 may include the inserts 1006 while others slots 238 do not. In various embodiments, the inserts 1006 are installed into the opening between the slot 238 and the cavity 236 to block or restrict flow into and out of the slots 238 via the opening proximate the cavity 236. For example, a cross-sectional flow area of the flow passage 1004 may be less than a cross-sectional flow area of the slots 238, thereby restricting flow. Furthermore, while the illustrated embodiment includes the flow passages 1004 substantially aligned with the slots 238, in various embodiments the flow passages 1004 may not be aligned with the slots 238. For example, the slots 238 may be substantially parallel to the axis 240 while the flow passages 1004 are arranged at an angle to the axis 240, as illustrated in FIG. 13.

In operation, as described above, introduction of fluid into the cavity 236 will drive sealing arms 232 radially outward toward the wellhead housing 206 and hanger 208, respectively. For example, the fluid may enter the cavity 236 via the test port 212 and the void 218. As the fluid enters the slots 238, via the passages 1204, the arms 232 rotate and/or pivot about respective joints 234. As the pressure of the fluid increases, so will the force applied to the primary sealing element 204, thereby improving the sealing properties between the actuating energizing ring 1102 and the primary sealing element 204.

It should be appreciated that, in various embodiments, one or more components described herein may be formed via an additive manufacturing process, thereby enabling a variety of different complex geometries without considering tool or manufacturing methods.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

What is claimed is:

1. A sealing assembly for use in an oil and gas operation, comprising:

a sealing element having a cavity between a first leg and a second leg, the first and second legs coupled together at a bottom of the sealing element and separated at a top by an opening leading to the cavity, and a test port extending through the first leg and the second leg into fluid communication with the cavity; and an energizing ring adapted for insertion into the cavity, the energizing ring driving the first leg and the second leg in opposite radial directions, the energizing ring comprising:

a passage fluidly coupled to the cavity, the passage extending through a width of the energizing ring; and a plurality of wings positioned along an inner diameter and an outer diameter of an energizing ring body, each wing of the plurality of wings comprising a sealing arm coupled to the energizing ring body at a joint, the sealing arm separated from at least a portion of the energizing ring body by a slot, wherein the respective sealing arms are configured to pivot relative to the joint in response to a fluid introduced into the cavity.

2. The sealing assembly of claim 1, wherein the sealing arm is arranged at an angle with respect to an axis of the energizing ring.

3. The sealing assembly of claim 1, wherein at least one slot is in direct fluid communication with the cavity.

4. The sealing assembly of claim 1, further comprising:

an insert positioned within at least one slot, the insert driving a respective arm radially outward from the energizing ring body.

5. The sealing assembly of claim 4, wherein the insert has a flow passage to fluidly couple the slot to the cavity.

6. The sealing assembly of claim 1, further comprising:

a void space between the test port and the passage, wherein the void space is at least partially isolated by at least one wing of the plurality of wings.

7. The sealing assembly of claim 1, wherein the sealing arm is arranged substantially parallel to an axis of the energizing ring.

8. The sealing assembly of claim 1, further comprising:

a longitudinal flow path extending along an axis of the energizing ring, wherein the longitudinal flow path is independent of the passage.

9. A wellbore system, comprising:

a wellhead housing having a bore;

a hanger positioned within the bore; and a sealing assembly arranged between the hanger and the bore to form a fluid seal, the sealing assembly comprising:

a sealing element having a cavity between a first leg and a second leg, the first and second legs coupled together at a bottom of the sealing element and separated at a top by an opening leading to the cavity, and a test port extending through the first leg and the second leg into fluid communication with the cavity; and an energizing ring adapted for insertion into the cavity, the energizing ring driving the first leg and the second leg in opposite radial directions, the energizing ring comprising:

a passage fluidly coupled to the cavity, the passage extending through a width of the energizing ring; and a wing extending radially outward from a body of the energizing ring, the wing comprising a sealing arm coupled to the body at a joint and a slot arranged between at least a portion of the sealing arm and the body, wherein the sealing arm is configured to pivot relative to the joint in response to a fluid pressure within the cavity.

10. The wellbore system of claim 9, wherein the sealing arm is arranged at an angle with respect to an axis of the energizing ring.

11. The wellbore system of claim 9, further comprising:

an insert positioned within the slot, the insert driving a respective arm radially outward from the body.

12. The wellbore system of claim 11, wherein the insert has a flow passage to fluidly couple the slot to the cavity.

13. The wellbore system of claim 9, wherein the sealing arm is arranged substantially parallel to an axis of the energizing ring.

14. The wellbore system of claim 9, further comprising:

a longitudinal flow path extending along an axis of the energizing ring, wherein the longitudinal flow path is independent of the passage.

15. The wellbore system of claim 9, further comprising:

a void space between the test port and the passage, wherein the void space is at least partially isolated by the wing.

16. The wellbore system of claim 9, further comprising:

a second wing, wherein at least one wing of the wing or the second wing is arranged along an inner diameter of the energizing ring and at least one of the wing or the second wing is arranged along an outer diameter of the energizing ring.

* * * * *